US009447582B2

(12) United States Patent
Even

(10) Patent No.: US 9,447,582 B2
(45) Date of Patent: Sep. 20, 2016

(54) ICE DAM PREVENTION SHIELD

(71) Applicant: Theodore J Even, Rochester, NY (US)

(72) Inventor: Theodore J Even, Rochester, NY (US)

( * ) Notice: Subject to any disclaimer, the term of this patent is extended or adjusted under 35 U.S.C. 154(b) by 0 days.

(21) Appl. No.: 14/625,001

(22) Filed: Feb. 18, 2015

(65) Prior Publication Data

US 2015/0240497 A1 Aug. 27, 2015

Related U.S. Application Data

(60) Provisional application No. 61/943,078, filed on Feb. 21, 2014.

(51) Int. Cl.
*E04D 13/10* (2006.01)
*E04D 13/076* (2006.01)

(52) U.S. Cl.
CPC ..... *E04D 13/10* (2013.01); *E04D 13/076* (2013.01); *E04D 13/106* (2013.01)

(58) Field of Classification Search
CPC ... E04D 13/10; E04D 13/076; E04D 13/106; E04D 5/146
See application file for complete search history.

(56) References Cited

U.S. PATENT DOCUMENTS 1,447,175 A * 3/1923 Henderson ..... E04D 5/142 52/467
1,615,105 A * 1/1927 Williams et al. ..... B61D 17/12 52/48
4,284,447 A * 8/1981 Dickens ..... B29C 33/16 156/299
4,437,283 A * 3/1984 Benoit ..... E04D 5/142 428/198
4,519,172 A * 5/1985 Ristow ..... E04D 5/143 52/410
4,625,469 A * 12/1986 Gentry ..... E04D 3/3601 52/3
4,712,348 A * 12/1987 Triplett ..... E04D 5/143 52/408
5,242,736 A * 9/1993 Van Erden ..... B29C 53/08 428/122
5,309,685 A * 5/1994 Rathgeber ..... E04D 5/142 428/189
5,349,804 A * 9/1994 Van Erden ..... B29C 53/08 264/150
5,452,558 A * 9/1995 Eastin ..... E04D 1/36 405/152
5,623,802 A * 4/1997 Boushek ..... B65D 85/671 52/543
5,983,588 A * 11/1999 Haddock ..... E04D 13/10 52/24
6,009,672 A * 1/2000 Kuhns ..... E04D 13/04 52/12
6,708,452 B1 * 3/2004 Tenute ..... E04D 13/0762 219/213
7,028,438 B2 * 4/2006 Burdic ..... E04D 13/16 52/105
7,954,279 B2 * 6/2011 Covone ..... E04D 13/15 52/58
8,137,170 B2 * 3/2012 Klement ..... E04D 13/178 126/621
2005/0055932 A1 * 3/2005 Hubbard ..... E04D 5/06 52/506.01
2005/0271852 A1 * 12/2005 Solomon ..... E04B 1/6141 428/58
2005/0279040 A1 * 12/2005 Panasik ..... E04D 5/12 52/407.3
2006/0174552 A1 * 8/2006 Nocito ..... E04D 13/10 52/95
2009/0000238 A1 * 1/2009 Hamlin, III ..... E04D 5/146 52/741.4
2010/0064602 A1 * 3/2010 Moore ..... E04D 13/1625 52/95
2010/0307076 A1 * 12/2010 McCowen ..... E04D 13/103 52/202
2011/0030287 A1 * 2/2011 Moore ..... E04D 13/1625 52/95
2015/0354218 A1 * 12/2015 Houchin ..... E04D 5/141 52/518

* cited by examiner

*Primary Examiner* — Joshua J Michener
*Assistant Examiner* — Alp Akbasli

(57) ABSTRACT

An ice dam prevention shield is a device that is installed onto a roof to prevent interior water damage due to the formation of an ice dam and to allow the user to easily remove the ice dam by striking an ice dam that has formed on top of the device with a striking tool. The device features a water-impermeable panel that is installed over the roof shingles and is secured to the roof via a set of roofing fasteners and a set of low head profile fasteners. A cushioning layer may be present in between the water-impermeable panel and the roof in order to allow the water-impermeable panel to flex when struck and facilitate the removal of the ice dam. A bottom anchoring strip is present in order to allow an ice dam to form on top of the water-impermeable panel rather than on top of the roof.

9 Claims, 9 Drawing Sheets

SECTION C-C

ICE DAM PREVENTION SHIELD

The current application claims a priority to the U.S. Provisional Patent application Ser. No. 61/943,078 filed on Feb. 21, 2014.

FIELD OF THE INVENTION

The present invention relates generally to a protective cover for a roof. More specifically, the present invention is an ice dam prevention shield that facilitates the removal of ice buildup on a roof, commonly known as ice dams. The present invention additionally prevents interior water damage due to the presence of ice dams.

BACKGROUND OF THE INVENTION

During the winter season, ice dam formation on roofs is a significant and costly problem. Ice dams are formed when water from melting snow flows down the heated portion of the roof (above the wall line) refreezes upon coming into contact with the unheated portion of the roof below the wall line. The melted water freezes, most commonly at the eaves of the roof, forming ice dams that prevent subsequently melting snow from draining properly off of the roof. Water accumulating due to the presence of ice dams can often leak through the roofing material and cause significant damage to the ceilings, walls, roof structure, and insulation of a building. Several means of preventing the formation of ice dams exist including heating panels, solar panels, and web heating cables. However, several drawbacks are present as well including the cost of electricity and the need for sunlight. Heating panels and web heating cables can pose a fire hazard in the event of any malfunctions. Additionally, heating panels and solar panels are very expensive to replace if damaged due to hail or trees falling onto roofs. Existing ice and water shields that are designed to prevent water damage from ice dam formation are often flawed as they are typically installed underneath roof shingles and cannot even facilitate the removal of ice dams. Additionally, since existing ice and water shields under the roof shingles are penetrated by multiple roofing nails and have seams, the shields often leak and allow water damage.

The present invention is an ice dam prevention shield that allows the user to easily remove ice dams as well as prevent interior water damage due to the presence of ice dams. The majority of the present invention is installed over the roof shingles while a top edge of the present invention is installed partially underneath a row of shingles in order to shed normal water flow over the present invention. The top row of shingles is then sealed back into place over the present invention in order to prevent wind damage to the top row of shingles. As such, ice dams are formed on top of the present invention rather than on top of the roof shingles. Because the present invention is installed on top of the roof shingles, there is not a large number of roofing nails puncturing the present invention once the present invention is in place. The present invention is installed in a manner such that the present invention is able to cover the roof from the gutter up to a short distance (approximately 1 foot) above the wall line. The present invention seeks to aid the removal of the source of potential interior water damage by allowing the user to simply tap an ice dam that has formed on top of the present invention in order to break up the ice dam. The dislodged ice dam may then be easily removed by sliding the ice dam off of the present invention. The present invention does not require electricity and may be easily installed by the user on top of an ice damming area on a roof. Additionally, there is no need for the user to maintain or otherwise modify the present invention once the present invention has been installed on the roof.

DETAIL DESCRIPTIONS OF THE INVENTION

All illustrations of the drawings are for the purpose of describing selected versions of the present invention and are not intended to limit the scope of the present invention.

Figure 1:
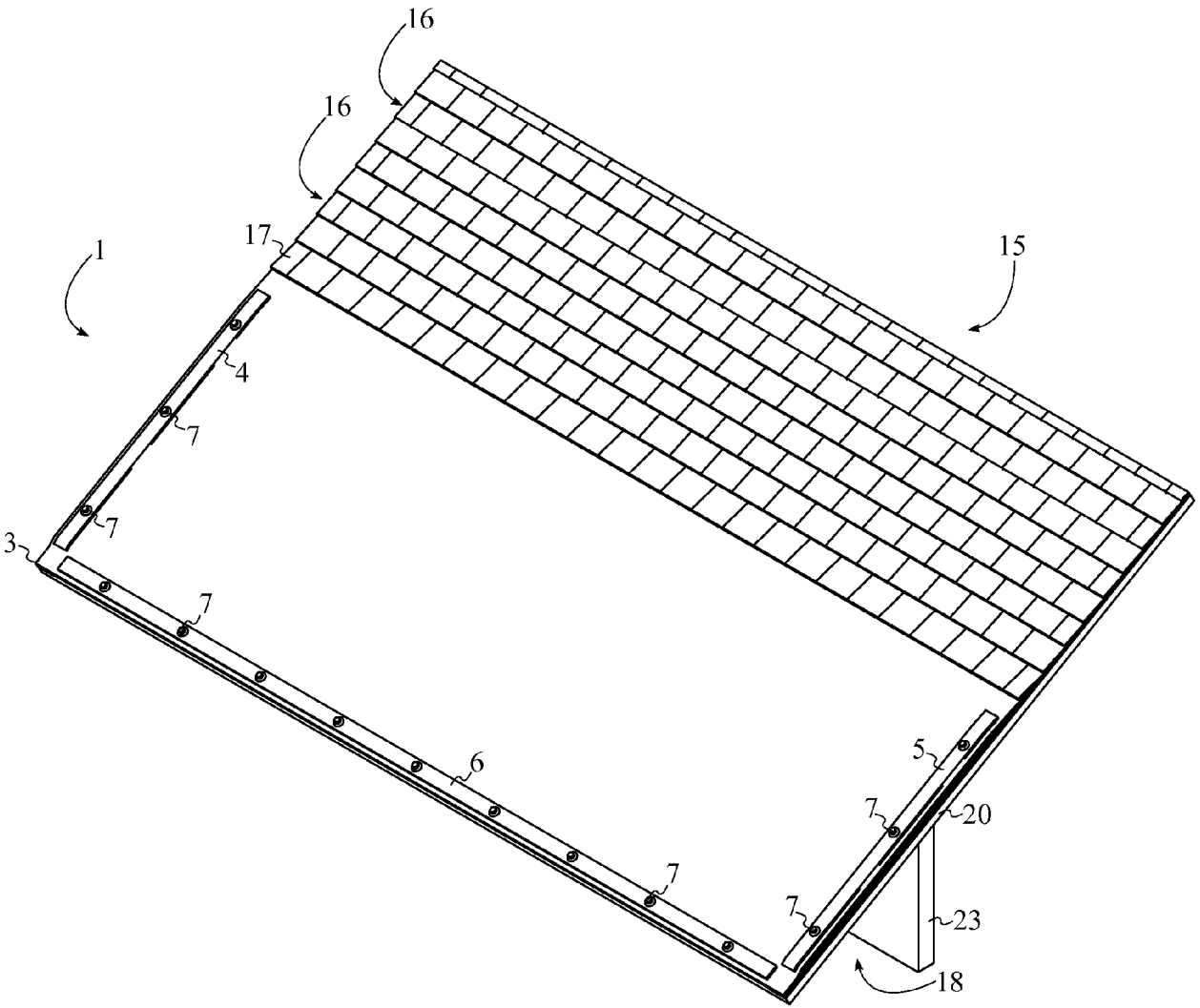
FIG. 1 is a perspective view of the present invention mounted to a roof.

The present invention is an ice dam prevention shield that prevents interior water damage due to the formation of ice dams and facilitates the removal of ice dams from a roof. With reference to FIG. 1, the present invention comprises a water-impermeable panel 1, a first anchoring strip 4, a second anchoring strip 5, and a bottom anchoring strip 6. The water-impermeable panel 1 serves as a cover that prevents ice buildup on top of the roof shingles and instead allows the ice buildup to occur on top of the water-impermeable panel 1. An ice dam that has formed on top of the water-impermeable panel 1 may be struck with a tool in order to dislodge the ice dam and allow the ice dam to simply slide off of the water-impermeable panel 1. In the preferred embodiment of the present invention, the water-impermeable panel 1 is composed of a material that is durable and resistant to both extremely high and low temperatures such as, but not limited to, polyethylene plastic. Resistance to extremely high and low temperatures allows the present invention to remain installed on a roof during all seasons of the year. The first anchoring strip 4, the second anchoring strip 5, and the bottom anchoring strip 6 are mounted onto the water-impermeable panel 1 in order to ensure that the water-impermeable panel 1 remains in place on the roof. As shown in FIGS. 2-6, the water-impermeable panel 1 comprises an insertion edge 2 and a bottom edge 3. The insertion edge 2 is tucked underneath the roof shingles in order to direct water flow from melting snow onto the top of the water-impermeable panel 1. The bottom edge 3 is placed adjacent to the lowermost edge of the roof. The insertion edge 2 and the bottom edge 3 are positioned opposite to each other across the water-impermeable panel 1. As such, the water-impermeable panel 1 is able to sufficiently cover a section of the roof extending from the insertion edge 2 to the bottom edge 3.

Figure 5:
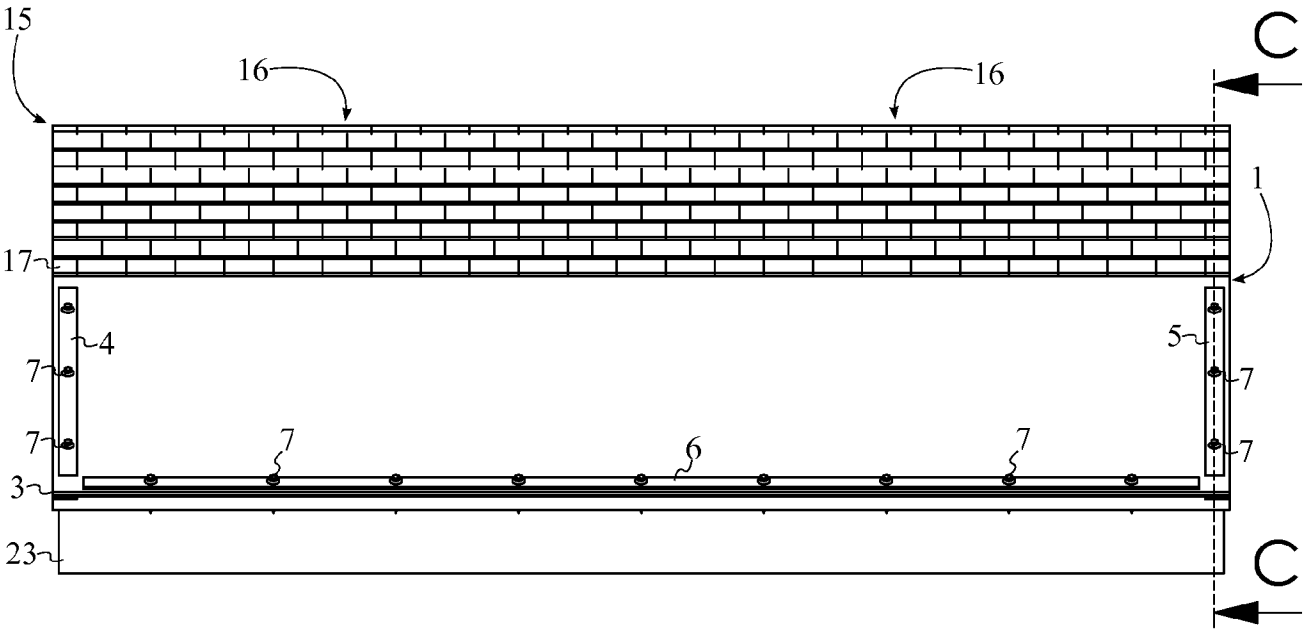
FIG. 5 is a front view of the present invention mounted to a roof.
Figure 6:
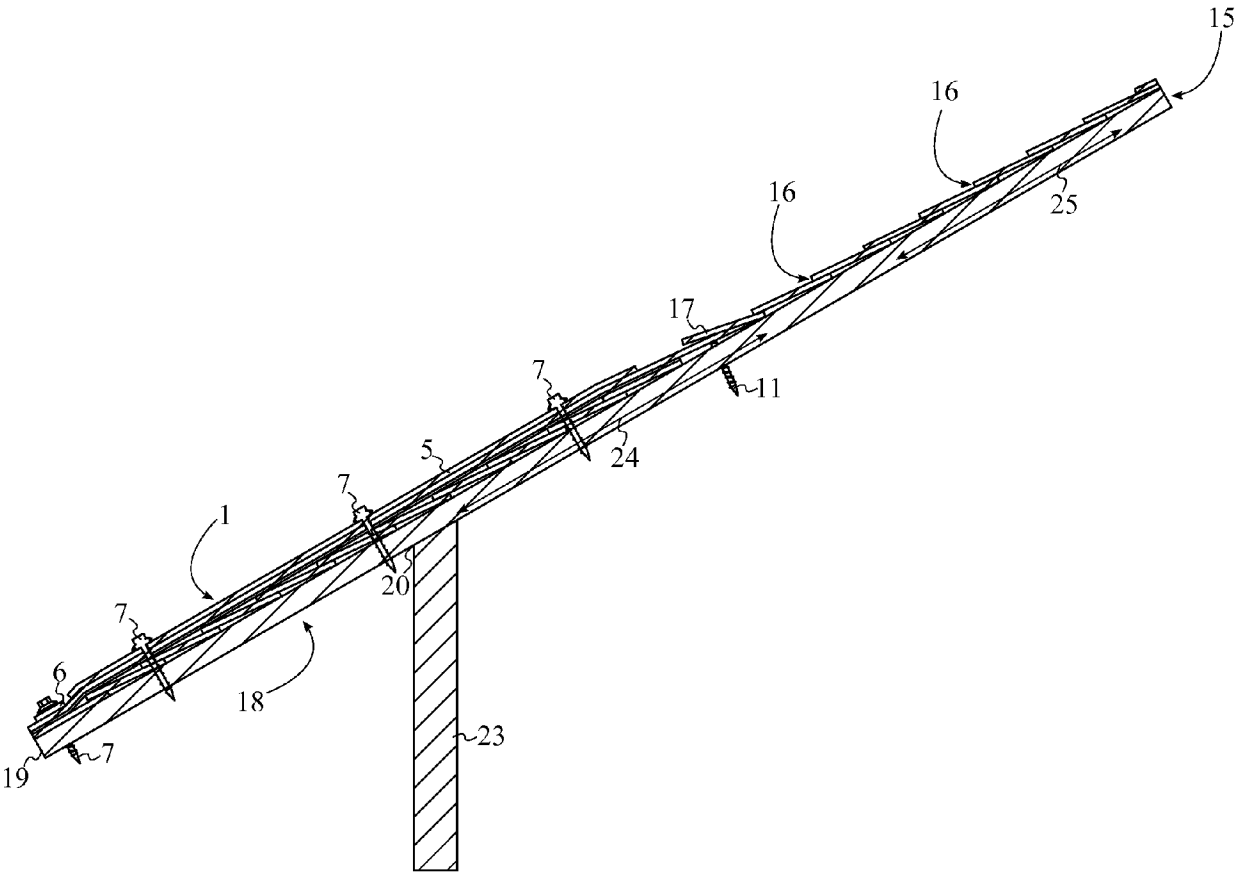
FIG. 6 is a cross-sectional view of the present invention mounted to a roof taken along line C-C of FIG. 5.

The first anchoring strip 4 and the second anchoring strip 5 are utilized to prevent the water-impermeable panel 1 from separating from the roof once installed (for example, due to high winds). As shown in FIG. 1 and FIG. 5, the first anchoring strip 4 and the second anchoring strip 5 are positioned opposite to each other across the water-impermeable panel 1. This allows the first anchoring strip 4 and the second anchoring strip 5 to secure down opposite ends of the water-impermeable panel 1. The first anchoring strip 4 and the second anchoring strip 5 are positioned in between the insertion edge 2 and the bottom edge 3. As such, the first anchoring strip 4 and the second anchoring strip 5 are able to secure the water-impermeable panel 1 along a length that extends from the insertion edge 2 to the bottom edge 3.

Figure 8:
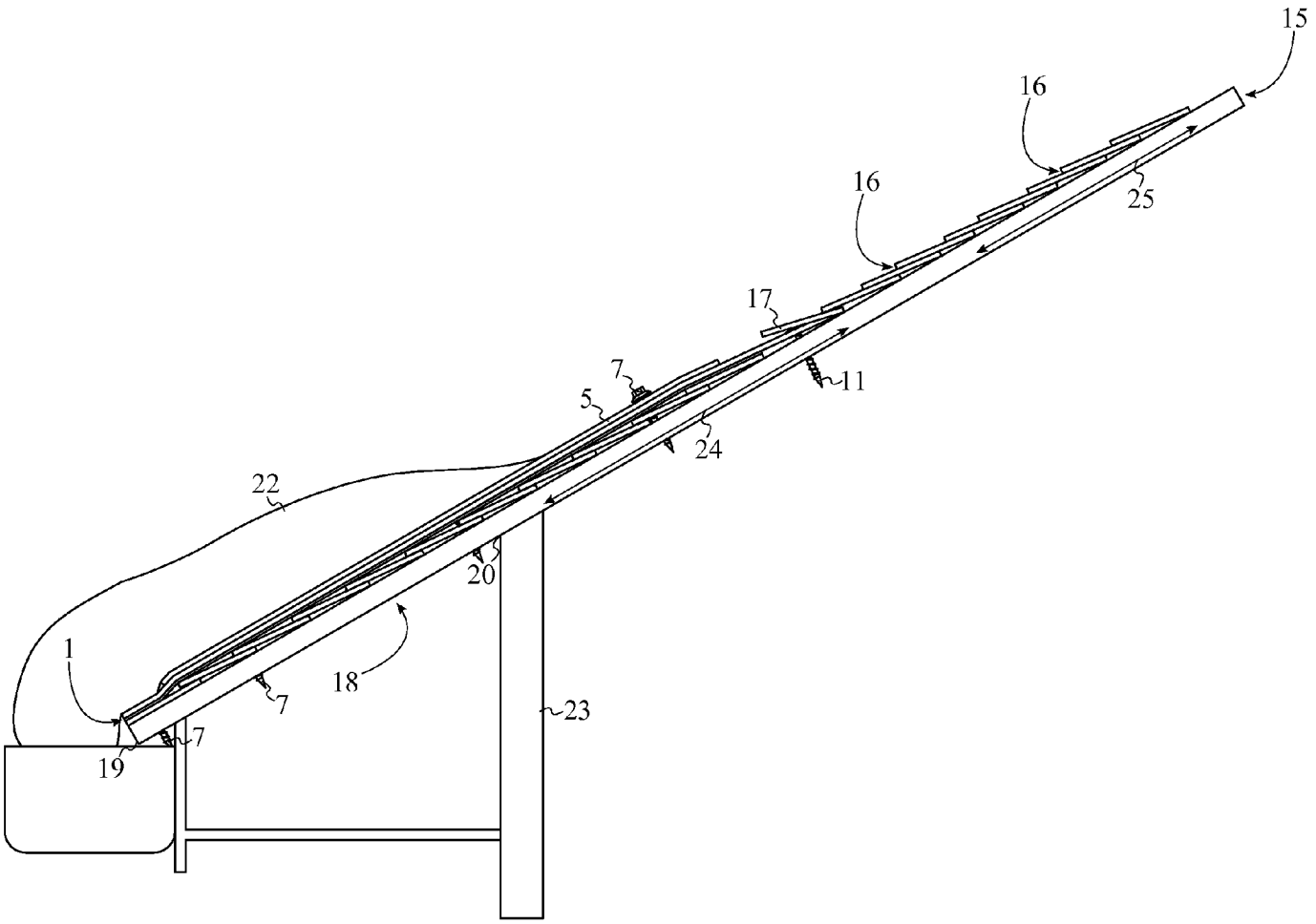
FIG. 8 is a side view of the present invention mounted to a roof and with an ice dam formed on top of the present invention.

The bottom anchoring strip 6 provides further security for the water-impermeable panel 1 on the roof at the lowermost point of the water-impermeable panel 1 as shown in FIG. 8. The bottom anchoring strip 6 is positioned adjacent and parallel to the bottom edge 3. This allows the bottom edge 3 to be secured in place (such as against high winds) once the water-impermeable panel 1 is installed.

Referring to FIGS. 1-6, the present invention further comprises a set of roofing fasteners 7. The set of roofing fasteners 7 is utilized to secure the water-impermeable panel 1 to the roof. The set of roofing fasteners 7 is distributed amongst the first anchoring strip 4, the second anchoring strip 5, and the bottom anchoring strip 6. This ensures that the water-impermeable panel 1 is held in place on the roof along the lengths of the first anchoring strip 4, the second anchoring strip 5, and the bottom anchoring strip 6. The set of roofing fasteners 7 traverses through the first anchoring strip 4, the second anchoring strip 5, and the bottom anchoring strip 6. Additionally, each of the set of roofing fasteners 7 traverses through the water-impermeable panel 1. This allows the set of roofing fasteners 7 to secure to the first anchoring strip 4, the second anchoring strip 5, and the bottom anchoring strip 6 as well as the water-impermeable panel 1 and the roof.

Figure 7:
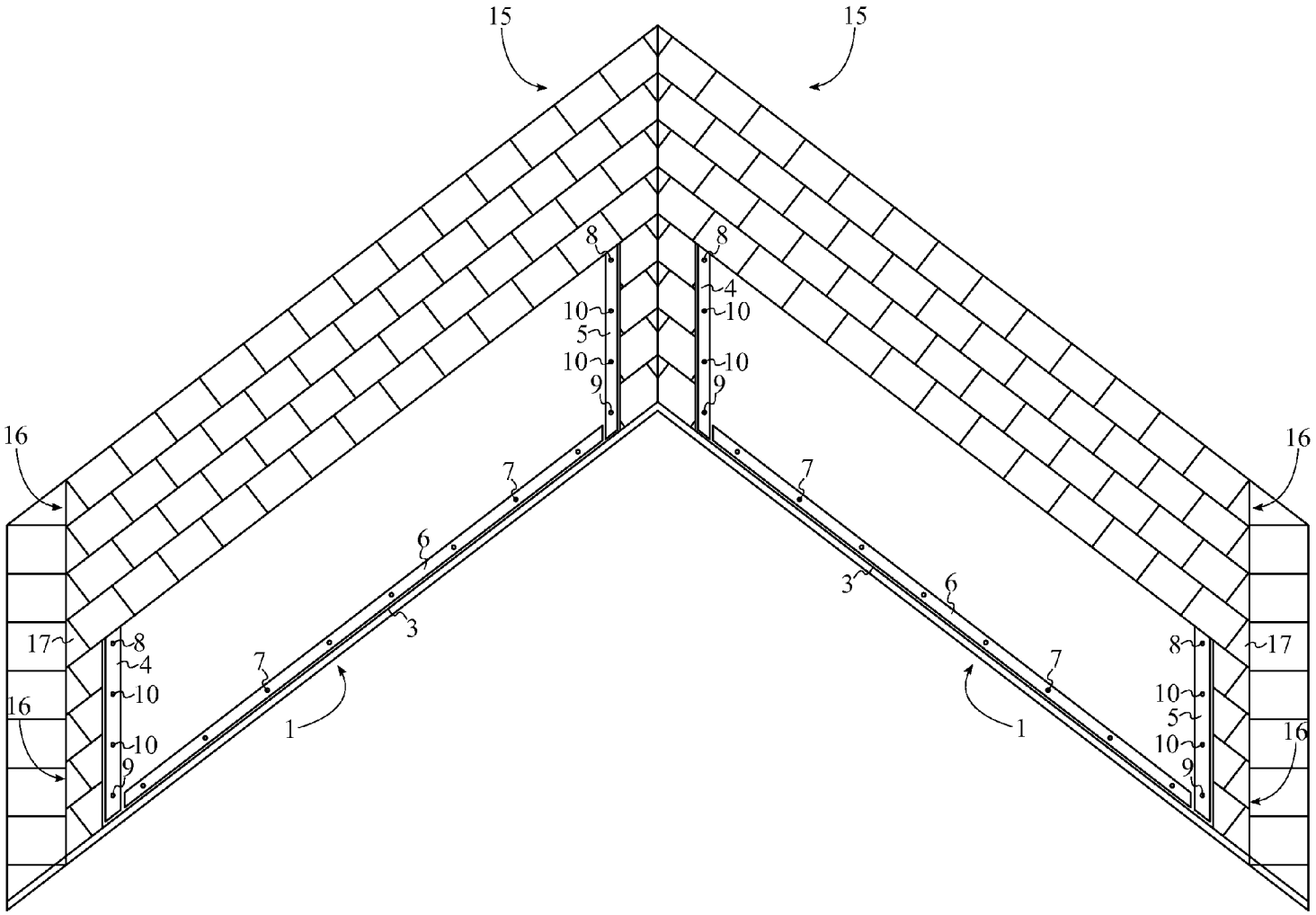
FIG. 7 is a top view of how multiple of the present invention may be mounted to a roof hip and valley.

With reference to FIG. 7, the present invention further comprises a plurality of rivets 10. The plurality of rivets 10 is utilized to secure the first anchoring strip 4 and the second anchoring strip 5 to the water-impermeable panel 1 when the present invention is mounted to a roof adjacent to a roof hip or roof valley. The set of roofing fasteners 7 comprises a top fastener 8 and a bottom fastener 9. The top fastener 8 and the bottom fastener 9 are utilized to further secure the first anchoring strip 4 to the water-impermeable panel 1 and the roof when the present invention is mounted to a roof adjacent to a roof hip or roof valley. The top fastener 8 and the bottom fastener 9 are positioned opposite to each other across the first anchoring strip 4. This allows the top fastener 8 and the bottom fastener 9 to secure opposing ends of the first anchoring strip 4. The plurality of rivets 10 is distributed along the first anchoring strip 4 in between the top fastener 8 and the bottom fastener 9. This allows the plurality of rivets 10 to secure the remainder of the first anchoring strip 4 to the water-impermeable panel 1 in between the top fastener 8 and the bottom fastener 9. Additionally, the plurality of rivets 10 eliminates the need for additional roofing fasteners passing through the roof, minimizing the likelihood of water leakage when the present invention is positioned adjacent to a roof hip or roof valley. The plurality of rivets 10 traverses through the first anchoring strip 4 and into the water-impermeable panel 1. This ensures that the plurality of rivets 10 is able to secure the water-impermeable panel 1 to the first anchoring strip 4 without any fasteners traversing through roof shingles, presenting a potential leakage source.

Similar to the first anchoring strip 4, an additional top fastener 8 and an additional bottom fastener 9 are utilized to secure the secure the second anchoring strip 5 to the water-impermeable panel 1 when the present invention is mounted adjacent to a roof hip or roof valley. The top fastener 8 and the bottom fastener 9 are positioned opposite to each other along the second anchoring strip 5, securing the two opposing ends of the second anchoring strip 5 to the water-impermeable panel 1 and the roof. The plurality of rivets 10 is distributed along the second anchoring strip 5 in between the top fastener 8 and the bottom fastener 9 as well in order to further secure the second anchoring strip 5 to the water-impermeable panel 1. The plurality of rivets 10 traverses through the second anchoring strip 5 and into the water-impermeable panel 1, allowing the plurality of rivets 10 to secure the second anchoring strip 5 in place without traversing through the roof shingles.

Figure 4:
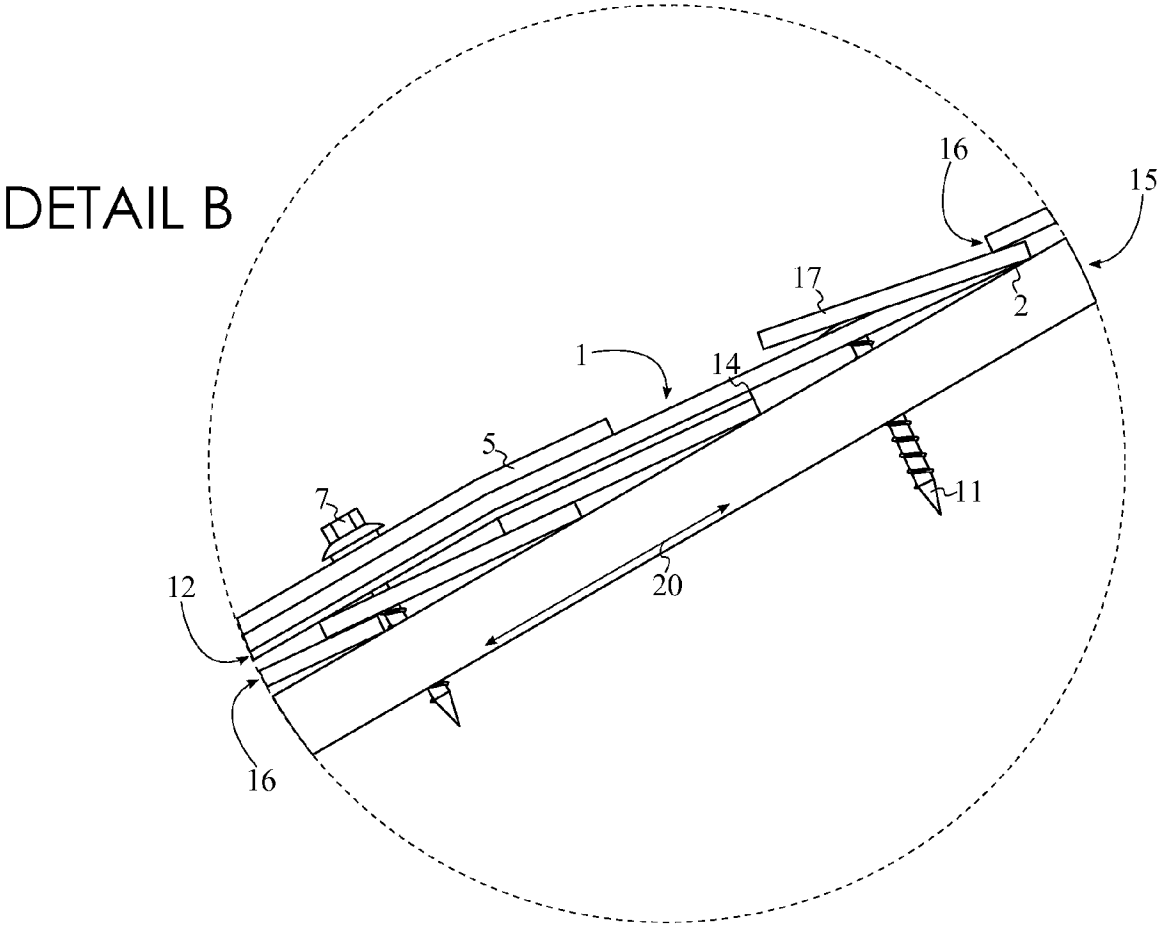
FIG. 4 is a detail view of the present invention mounted to a roof taken from circle B of FIG. 2.

The present invention further comprises a set of low head profile fasteners 11. As shown in FIG. 4, the set of low head profile fasteners 11 is utilized to secure the insertion edge 2 to the roof without greatly affecting the ability to re-fasten the roof shingles in place after the user has installed the present invention. The set of low head profile fasteners 11 is evenly distributed along the insertion edge 2 in order to secure the insertion edge 2 to the roof at multiple points. The set of low head profile fasteners 11 traverses through the water-impermeable panel 1 in order to secure the set of low head profile fasteners 11 to the roof and to the water-impermeable panel 1.

Figure 3:
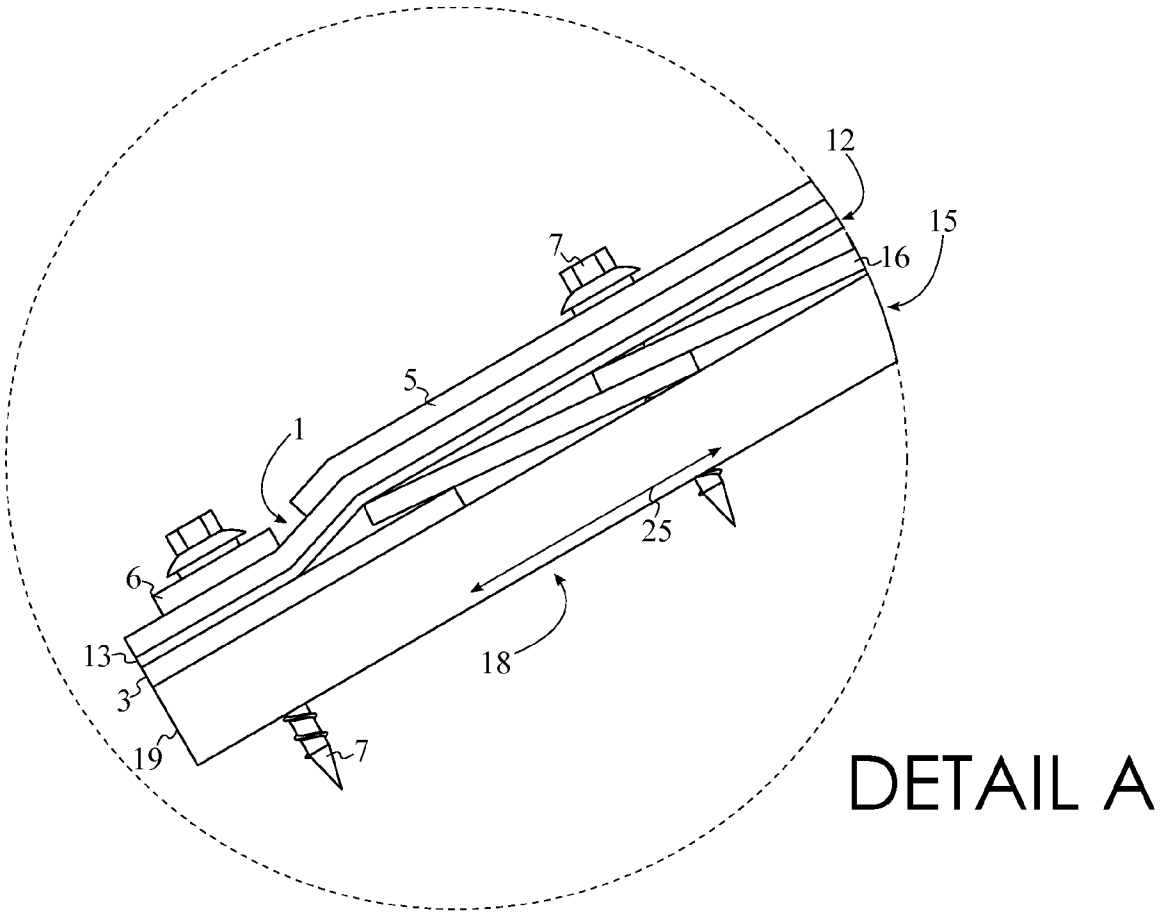
FIG. 3 is a detail view of the present invention mounted to a roof taken from circle A of FIG. 2.

With reference to FIG. 3 and FIG. 4, the present invention further comprises a cushioning layer 12. The cushioning layer 12 provides a level of protection for the roof shingles when the present invention is in place on a roof. Because one of the objects of the present invention is to facilitate the removal of an ice dam by simply striking the ice dam formed on top of the present invention, it is important that the present invention is able to give way sufficiently to allow the ice dam to become dislodged. As such, it is important that the cushioning layer 12 exhibits impact dampening properties as well as cushioning properties. This allows the cushioning layer 12 to provide flexing capability to the water-impermeable panel 1 when the water-impermeable panel 1 is struck. In the preferred embodiment of the present invention, the cushioning layer 12 is made of foam rubber. The cushioning layer 12 comprises a base edge 13 and a top edge 14. The base edge 13 and the top edge 14 allow the cushioning layer 12 to be positioned relative to the bottom edge 3 and the insertion edge 2 in order to provide sufficient protection for the shingles underneath the water-impermeable panel 1. The water-impermeable panel 1 is superimposed upon the cushioning layer 12, opposite the first anchoring strip 4, the second anchoring strip 5, and the bottom anchoring strip 6. As such, the cushioning layer 12 is positioned adjacent to the shingles when the water-impermeable panel 1 is installed on the roof, allowing the cushioning layer 12 to provide protection to the shingles. The base edge 13 is coincident with the bottom edge 3 in order to provide protection from the cushioning layer 12 to the shingles adjacent to the bottom edge 3. Conversely, the top edge 14 is offset from the insertion edge 2 in order to facilitate the process of sliding the insertion edge 2 underneath the shingles when installing the present invention onto the roof.

Figure 9:
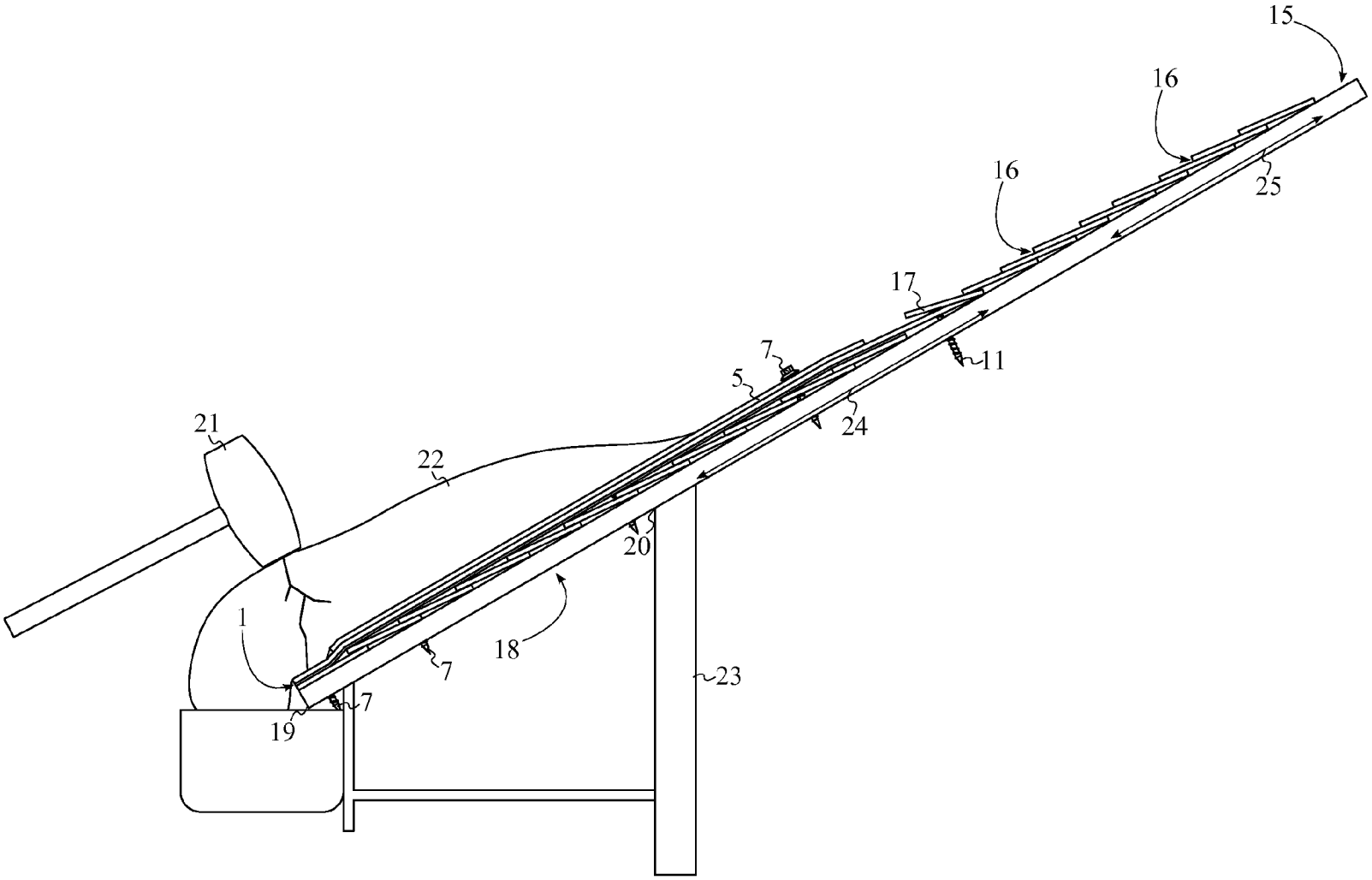
FIG. 9 is a side view of the present invention mounted to a roof with an ice dam formed on top of the present invention and a striking tool for dislodging the ice dam.

The present invention may be mounted to a roof 15 as shown in FIGS. 1-6. A typical roof 15 comprises rows of shingles 16 extending along the surface of the roof 15 as well as an eave 18 that forms an overhang. The rows of shingles 16 are capable of repelling water as well as improve the aesthetics of the roof 15. The set of roofing fasteners 7 and the set of low head profile fasteners 11 are required in order to mount the present invention to the roof 15. Once the present invention has been mounted to the roof 15 and an ice dam 22 has formed on top of the present invention, a striking tool 21 is utilized to dislodge the ice dam 22 from the present invention. When installing the present invention, the bottom edge 3 of the water-impermeable panel 1 is first positioned coincident to a distal end 19 of the eave 18. This ensures that the bottom edge 3 of the water-impermeable panel 1 is able to extend down to the distal end 19 of the eave 18 without extending beyond or falling short of the distal end 19 of the eave 18. The first anchoring strip 4, the second anchoring strip 5, the bottom anchoring strip 6, and the water-impermeable panel 1 are mounted to the roof 15 with the set of roofing fasteners 7 and the set of low head profile fasteners 11. As such, the set of roofing fasteners 7 and the set of low head profile fasteners 11 are able to securely fasten the water-impermeable panel 1 to the roof 15. After the present invention is in place on the roof 15, water is able to accumulate on the water-impermeable panel 1 adjacent to the bottom anchoring strip 6 in order to form an ice dam 22 on the water-impermeable panel 1. This prevents the ice dam 22 from forming on top of the roof 15 itself and prevents the ice dam 22 from coming into contact with the roof 15 as well. The ice dam 22 is then dislodged from the water-impermeable panel 1 by hitting the ice dam 22 with the striking tool 21 as shown in FIG. 9, allowing the ice dam 22 to simply slide off of the water-impermeable panel 1. Once the present invention is installed, ice formed in the gutter is not a potential water damage threat and does not need to be removed. As such, only ice formed on the water-impermeable panel 1 above the gutter ice needs to be removed.

The method of installing the present invention to the roof 15 is explained in further detail herein. Prior to securing the present invention to the roof 15, a mounting row 17 is selected from the rows of shingles 16. The mounting row 17 is the shingle row which the insertion edge 2 is inserted underneath when installing the present invention onto the roof 15 as shown in FIG. 4. The mounting row 17 is identified as one of the rows of shingles 16 that is closest to the insertion edge 2 once the water-impermeable panel 1 is in place on the roof 15. This allows the insertion edge 2 to be inserted underneath the mounting row 17. The mounting row 17 is peeled from the roof 15 and the insertion edge 2 is slid underneath the mounting row 17. Positioning the insertion edge 2 underneath the mounting row 17 allows water from melting snow to flow downward and onto the water-impermeable panel 1 and any snow on the water-impermeable panel 1. This allows an ice dam 22 to form on top of the water-impermeable panel 1 rather than on the roof 15 itself as shown in FIG. 8. Once the ice dam 22 is formed, the ice dam 22 does not come into contact with the roof 15 and is unable to cause a potential leak of water back underneath the shingles and through the roof 15.

After the bottom edge 3 is positioned coincident to the distal end 19 and the insertion edge 2 is slid underneath the mounting row 17, the bottom edge 3 is aligned coincident to the distal end of the eave 18 in order to position the bottom edge 3 directly adjacent to the distal end 19 and provide protection for the roof 15 down to the distal end 19. The set of roofing fasteners 7 is inserted through the first anchoring strip 4, the second anchoring strip 5, and the bottom anchoring strip 6 in order to secure the first anchoring strip 4, the second anchoring strip 5, and the bottom anchoring strip 6 to the water-impermeable panel 1. Additionally, the set of roofing fasteners 7 is inserted through the water-impermeable panel 1 and into the roof 15 to secure the first anchoring strip 4, the second anchoring strip 5, the bottom anchoring strip 6, and the water-impermeable panel 1 to the roof 15. Each of the set of low head profile fasteners 11 is inserted through the water-impermeable panel 1 and into the roof 15, adjacent to the insertion edge 2. This allows the mounting row 17 to be reattached to the roof 15 without any hindrance. The mounting row 17 is reattached to the roof 15 over the insertion edge 2 and the set of low head profile fasteners 11. This ensures that the set of low head profile fasteners 11 is covered by the mounting row 17 and not exposed to the elements.

Figure 2:
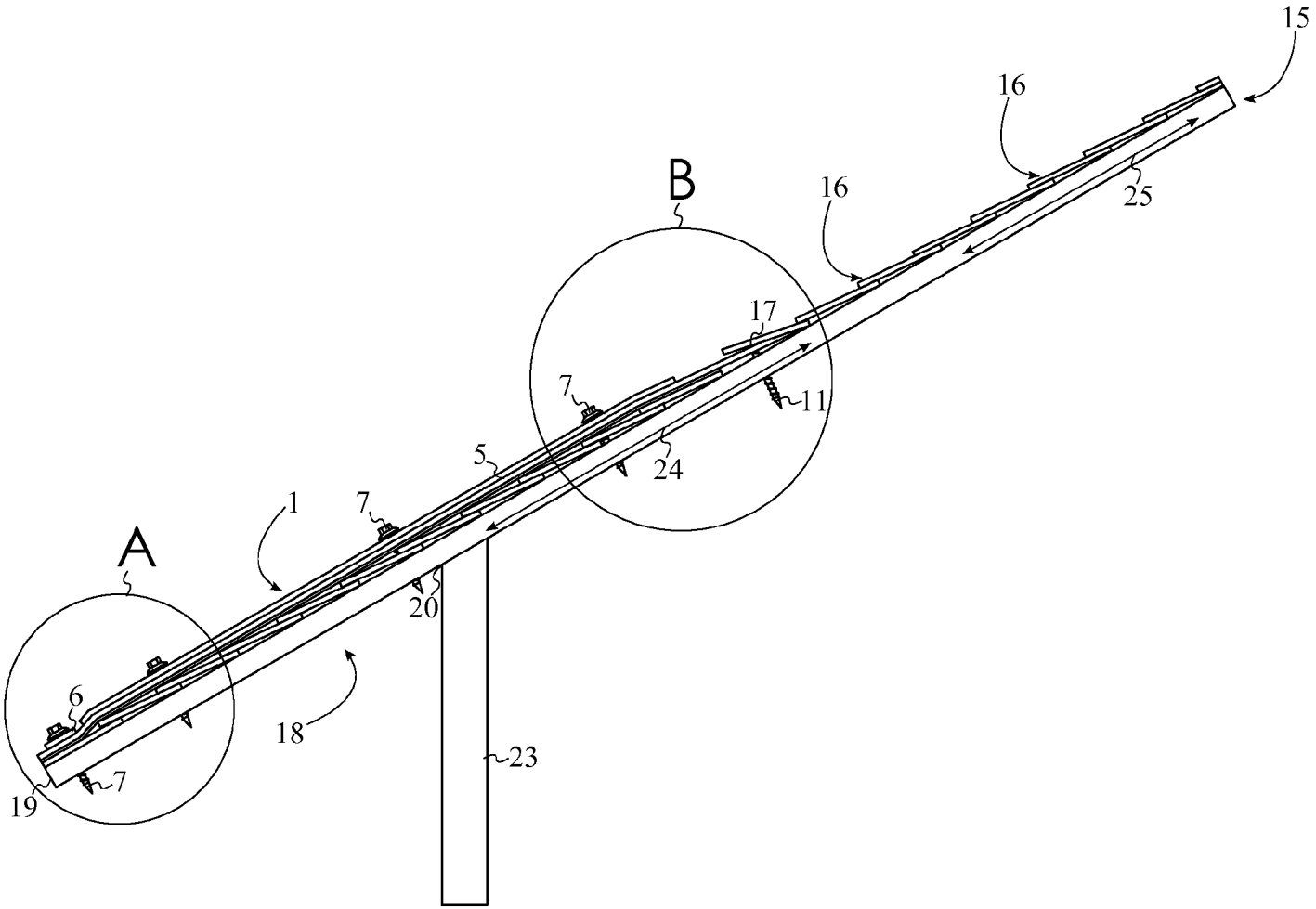
FIG. 2 is a side view of the present invention mounted to a roof.

The eave 18 of the roof 15 forms an overhang with a wall 23 that intersects the roof 15 at a proximal end 20 of the eave 18. When installing the present invention, it is important that the insertion edge 2 is positioned sufficiently above the wall line (approximately 1 foot) where the wall 23 intersects the roof 15. This ensures that the water-impermeable panel 1 is positioned at an elevation located above the wall line and is able to provide sufficient protection from leaks above the wall line in order to prevent interior water damage. In order to ensure that the insertion edge 2 is located above the wall line, the insertion edge 2 is offset from the wall 23 by a specified distance 24, wherein the specified distance 24 is coincident with a slope 25 of the roof 15 as shown in FIG. 2. The water-impermeable panel 1 is thus able to provide sufficient coverage for the roof 15 from the distal end 19 to the specified distance 24 above the wall line. The mounting row 17 is then identified as one of the rows of shingles 16 closest to the insertion edge 2.

In the preferred embodiment of the present invention, roofing tar is applied underneath the mounting row 17 just over the insertion edge 2 in order to reattach the mounting row 17 to the roof 15 over the insertion edge 2 and the set of low head profile fasteners 11. The roofing tar is able to adhesively hold the shingles of the mounting row 17 in place over the insertion edge 2.

The present invention offers a number of advantages over conventional means of preventing damage due to ice dams. Perhaps most importantly, the present invention allows the user to simply remove an ice dam that has formed on a roof without the need to employ professional services (e.g. a hot steamer company). The present invention is highly effective in eliminating the potential source of interior water damage due to the formation of an ice dam as ice dams are only able to form on top of the water-impermeable panel 1 rather than on the roof shingles. This prevents water from leaking through the roof and additionally allows the user to simply strike the ice dam, causing the ice dam to slide off of the water-impermeable panel 1. The present invention is convenient for the user to install onto an old or new roof due to the simplicity of the fasteners and minimal materials needed to install the present invention. Once the present invention has been installed onto a roof, there is no need to maintain or otherwise modify the present invention, allowing the user to simply leave the present invention in place year after year. Additionally, the present invention is inexpensive and cost-effective relative to heating panels, solar panels, and web heating cables that are capable of melting ice and snow, but incur significant electrical costs on the user. Heating panels, solar panels, and web heating cables may serve as fire hazards as well and are expensive to replace. Conversely, replacement of the present invention in the event of damage is not a significant financial expense. Furthermore, unlike the present invention, heating panels, solar panels, and web heating cables are often fragile and can be damaged when raking snow off of a roof. Finally, these conventional means of melting ice and snow are often unreliable due to environmental factors hindering their effectiveness. For example, web heating cable systems are often typically ineffective below 30 degrees Fahrenheit in which the systems are most needed. The effectiveness of solar panels is also dependent on the panels' exposure to the sun as well and may be ineffective on certain days. The present invention maintains a low profile relative to the aforementioned means of melting ice and snow and may be colored or otherwise designed to assimilate with the roof shingles. As such, the water-impermeable panel 1 may be designed to mimic the physical appearance and texture of roof shingles.

Although the present invention has been explained in relation to its preferred embodiment, it is understood that many other possible modifications and variations can be made without departing from the spirit and scope of the present invention as hereinafter claimed.

What is claimed is:

1. An ice dam prevention shield comprises:
a water-impermeable panel;
a first anchoring strip;
a second anchoring strip;
a bottom anchoring strip;
the water-impermeable panel comprises an insertion edge and a bottom edge;
the insertion edge and the bottom edge being positioned opposite to each other across the water-impermeable panel;
the first anchoring strip, the second anchoring strip, and the bottom anchoring strip being mounted onto the water-impermeable panel;
the first anchoring strip and the second anchoring strip being positioned opposite to each other across the water-impermeable panel;
the first anchoring strip and the second anchoring strip being positioned in between the insertion edge and the bottom edge;
the bottom anchoring strip being positioned adjacent and parallel to the bottom edge;
a set of low head profile fasteners;
the set of low head profile fasteners being evenly distributed along the insertion edge;
the set of low head profile fasteners traversing through the water-impermeable panel;
a cushioning layer, wherein the cushioning layer is made of foam rubber;
the cushioning layer comprises a base edge and a top edge;
the water-impermeable panel being superimposed upon the cushioning layer, opposite the first anchoring strip, the second anchoring strip, and the bottom anchoring strip;
the base edge being coincident with the bottom edge;
the top edge being offset from the insertion edge.

2. The ice dam prevention shield as claimed in claim 1 further comprises:
a set of roofing fasteners;
the set of roofing fasteners being distributed amongst the first anchoring strip, the second anchoring strip, and the bottom anchoring strip;
the set of roofing fasteners traversing through the first anchoring strip, the second anchoring strip, and the bottom anchoring strip; and
each of the set of roofing fasteners traversing through the water-impermeable panel.

3. The ice dam prevention shield as claimed in claim 2 further comprises:
a plurality of rivets;
the set of roofing fasteners comprises a top fastener and a bottom fastener;
the top fastener and the bottom fastener being positioned opposite to each other along the first anchoring strip, wherein the first anchoring strip is positioned adjacent to a hip or a valley of a roof;
the plurality of rivets being distributed along the first anchoring strip in between the top fastener and the bottom fastener; and
the plurality of rivets traversing through the first anchoring strip and into the water-impermeable panel.

4. The ice dam prevention shield as claimed in claim 2 further comprises:
a plurality of rivets;
the set of roofing fasteners comprise a top fastener and a bottom fastener;
the top fastener and the bottom fastener being positioned opposite to each other along the second anchoring strip, wherein the second anchoring strip is positioned adjacent to a hip or a valley of a roof;
the plurality of rivets being distributed along the second anchoring strip in between the top fastener and the bottom fastener; and
the plurality of rivets traversing through the second anchoring strip and into the water-impermeable panel.

5. An ice dam prevention shield comprises:
a water-impermeable panel;
a first anchoring strip;
a second anchoring strip;
a bottom anchoring strip;
a cushioning layer;
the water-impermeable panel comprises an insertion edge and a bottom edge;
the cushioning layer comprises a base edge and a top edge;
the insertion edge and the bottom edge being positioned opposite to each other across the water-impermeable panel;
the first anchoring strip, the second anchoring strip, and the bottom anchoring strip being mounted onto the water-impermeable panel;
the first anchoring strip and the second anchoring strip being positioned opposite to each other across the water-impermeable panel;
the first anchoring strip and the second anchoring strip being positioned in between the insertion edge and the bottom edge;
the bottom anchoring strip being positioned adjacent and parallel to the bottom edge;
the water-impermeable panel being superimposed upon the cushioning layer, opposite the first anchoring strip, the second anchoring strip, and the bottom anchoring strip;
the base edge being coincident with the bottom edge;
the top edge being offset from the insertion edge;
a set of low head profile fasteners;
the set of low head profile fasteners being evenly distributed along the insertion edge; and the set of low head profile fasteners traversing through the water-impermeable panel.

6. The ice dam prevention shield as claimed in claim 5, wherein the cushioning layer is made of foam rubber.

7. The ice dam prevention shield as claimed in claim 5 further comprises:

a set of roofing fasteners;

the set of roofing fasteners being distributed amongst the first anchoring strip, the second anchoring strip, and the bottom anchoring strip;

the set of roofing fasteners traversing through the first anchoring strip, the second anchoring strip, and the bottom anchoring strip; and each of the set of roofing fasteners traversing through the water-impermeable panel.

8. The ice dam prevention shield as claimed in claim 7 further comprises:

a plurality of rivets;

the set of roofing fasteners comprises a top fastener and a bottom fastener;

the top fastener and the bottom fastener being positioned opposite to each other along the first anchoring strip, wherein the first anchoring strip is positioned adjacent to a hip or a valley of a roof;

the plurality of rivets being distributed along the first anchoring strip in between the top fastener and the bottom fastener; and the plurality of rivets traversing through the first anchoring strip and into the water-impermeable panel.

9. The ice dam prevention shield as claimed in claim 7 further comprises:

a plurality of rivets;

the set of roofing fasteners comprise a top fastener and a bottom fastener;

the top fastener and the bottom fastener being positioned opposite to each other along the second anchoring strip, wherein the second anchoring strip is positioned adjacent to a hip or a valley of a roof;

the plurality of rivets being distributed along the second anchoring strip in between the top fastener and the bottom fastener; and the plurality of rivets traversing through the second anchoring strip and into the water-impermeable panel.

* * * * *